United States Patent [19]

Troebel et al.

[11] 4,274,069

[45] Jun. 16, 1981

[54] LOCKING ARRANGEMENT FOR ELECTRIC CIRCUIT BREAKERS

[75] Inventors: Werner Troebel; Klaus-Dieter Habedank, both of Berlin, Fed. Rep. of Germany

[73] Assignee: Siemens Aktiengesellschaft, Munich & Berlin, Fed. Rep. of Germany

[21] Appl. No.: 17,919

[22] Filed: Mar. 6, 1979

[30] Foreign Application Priority Data

Mar. 7, 1978 [DE] Fed. Rep. of Germany ..... 2810233

[51] Int. Cl.[3] ..... H01H 73/02; H01H 75/00

[52] U.S. Cl. ..... 335/21; 200/318; 335/172

[58] Field of Search ..... 335/167, 44, 172, 21, 335/23, 35, 38, 6; 337/72; 200/318

[56] References Cited

U.S. PATENT DOCUMENTS

| | | | |
|---|---|---|---|
| 3,178,535 | 4/1965 | Gelzheiser et al. | 335/44 |
| 3,796,980 | 3/1974 | Ellsworth | 335/72 |

*Primary Examiner*—Harold Broome
*Attorney, Agent, or Firm*—Kenyon & Kenyon

[57] ABSTRACT

In a locking arrangement of an electric circuit breaker which includes a latch and a locking strap which cooperates with the latter and is supported by means of two pivots in support openings of stationary parts, the pivots having a rectangular cross-section and arranged so that the force exerted by the latch on the locking strap is transmitted to one of the small surfaces of the pivots, the support openings have a convex surface which cooperates with the one small surface of the pivot and the long surfaces of the pivots are opposite similarly convex surfaces of the support openings. For the other small surface of the pivots, a concave surface or a surface which consists of two subsurfaces which are at an angle to each other and are connected by a transition arc is provided. The pivots cooperate with the support openings by rolling and sliding motions which insure low stress on the contact surfaces.

4 Claims, 7 Drawing Figures

LOCKING ARRANGEMENT FOR ELECTRIC CIRCUIT BREAKERS

BACKGROUND OF THE INVENTION

The invention relates to circuit breakers in general and more particularly to a locking arrangement for electric circuit breakers with a latch and a locking strap which cooperates with the latter and is rotatably or tiltably supported by means of two pivots lying on a common ideal axis in support openings in stationary parts, wherein the cross section of the pivots is rectangular and one of the small surfaces of the pivots can respectively be acted upon by the force to be locked.

A locking arrangement of this type is disclosed, for instance, in U.S. Pat. Nos. 3,178,535 and 3,796,980. In these arrangements, the support opening has the shape of a tetragon with two surfaces arranged at an angle to each other. The approximately knife edge-like support of the locking strap can be made by simple cutting operations that can be carried out by machine, and is therefore suitable for switching equipment that is to be produced in large quantities. However, the load carrying capacity of the locking strap is relatively low because relatively high stresses, which lead to rapid wear, occur at the edges of the small surface of the pivots acted upon by the locking force. In addition, the force cycle is dependent on the number of switching cycles.

SUMMARY OF THE INVENTION

It is an object of the present invention to provide a support for a locking arrangement of the type mentioned above which can likewise be made by machine cutting operations, operates without wear and with a minimum of bearing friction and in which the force required for tripping changes only slightly during the course of use of the circuit breaker. According to the present invention, this object is attained by disposing the small surface of each pivot opposite a convex surface of a corresponding support opening and disposing both long surfaces, with play, opposite similarly convex surfaces of the support opening. If in this arrangement, the locking strap is rotated or tilted for releasing the latch, then rolling and sliding motion takes place between the pivot and the associated support opening, from which the edges of the pivot are excepted. With suitable design of the radii of curvature of the convex surfaces, particularly low stresses can be achieved. The material of the pivot and of the counter surfaces of the support openings is saved thereby, so that the bearing tolerance and the force required for tripping do not change objectionably over the specified number of switching cycles.

The other small surface of each pivot can be opposite a concave surface of the support opening. Thereby, a small amount of play of the pivot in the direction of the long surfaces of the rectangular cross-section is obtained. The fact that in this arrangement the edges of the one small side of the pivot rest against the concave surface is of little importance for the durability of the arrangement, because the forces acting in the direction of the concave surface are substantially smaller than the forces excerted by the latch on the locking strap in the opposite direction.

The counter surface of the support opening, which is opposite the other small surface of each pivot, can also be formed by two subsurfaces which are at an angle to each other and are connected by a transition arc. In this manner, support of the locking strap with little play can be achieved even if the tilting angle is relatively large.

DETAILED DESCRIPTION OF THE INVENTION

Figure 1:
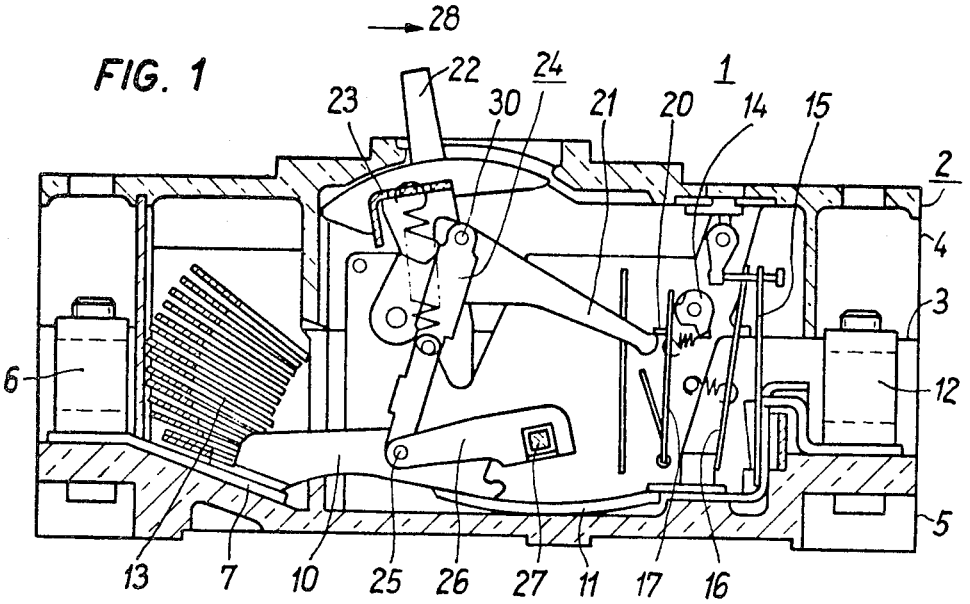
FIG. 1 is a diagrammatic cross-section of an electric circuit breaker.

The circuit breaker 1 shown in FIG. 1 has an insulating housing 2 made of molded plastic which is divided into an upper part 4 and a lower part 5 along a parting line 3. The current path of the circuit breaker 1 extends from a connecting device 6 via a fixed contact 7 and a movable contact 10 as well as a flexible conductor ribbon 11 to a further connecting device 12. The stationary contact 7 and the movable contact 10 are arranged in a quenching chamber 13 in a manner known per se. Between the conductor ribbon 11 and the terminal 12 there is a thermal bimetal strip 15 and an electromagnetic tripping magnet armature 16, which act together on a tripping shaft 14. The connection of the bimetal strip 15 and the magnet armature 16 to the tripping shaft 14 is not shown specifically.

The tripping shaft 14 is in connection with a locking strap 17, the projection 20 of which serves as an abutment of a latch 21 of the latching mechanism of the circuit breaker 1.

For operation by hand, the circuit breaker 1 has an operating handle 22 which protrudes through an opening in the upper part 4 of the housing 2. Inside the housing 2, the operating handle 22 is connected to a drive lever 23 which actuates a system of toggle levers 24 which engages the connecting joint 25 of the movable contact 10 with a contact carrier 26. A switching shaft 27 transmits the motion of the contact carrier 26 to adjacent pole channels, not shown, of the circuit breaker 1. From the "on" position shown, the movable contact 10 can be transferred into the "off" position by moving the operating handle 22 in the direction of the arrow 28. The latch 21 and the locking strap 17 remain in the position shown. If, however, the thermal or the magnetic tripping device responds, the locking strap 17 is swung clockwise and the latch 21 is released. The support 30 of the toggle lever system is thereby removed, so that the contact carrier 25 and thereby, the movable contact 10 are likewise swung clockwise into the "of" position. As a result of this process, the operating handle occupies an intermediate position between the "on" position shown and the "off" position (not shown), whereby it can be seen that the breaker was tripped (trip position).

Figure 2:
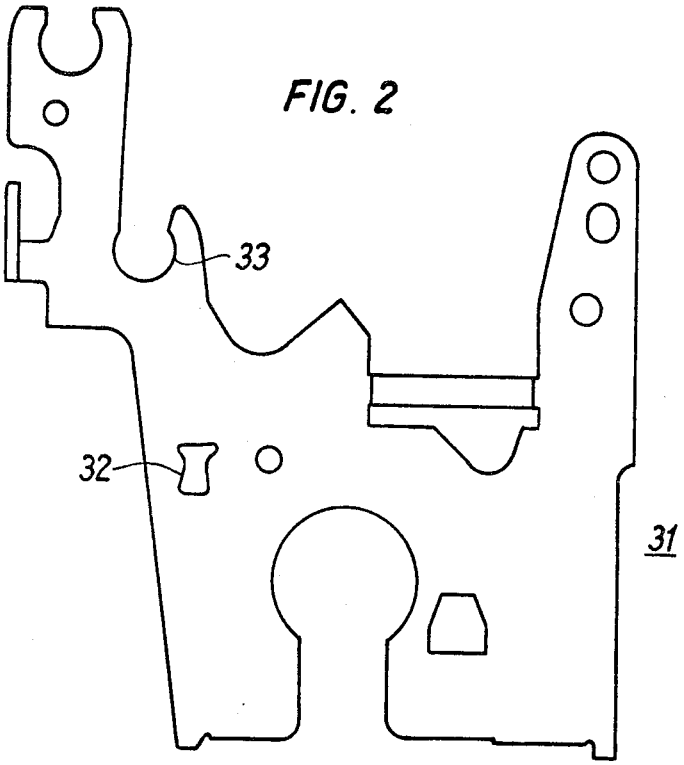
FIG. 2 shows a support part for a locking strap which can be attached firmly in the housing of the circuit breaker.

In FIG. 2, an example of a support part for supporting the locking latch 17 is shown. The support part 31 is a stamped part made of sheet metal which is provided with a multiplicity of support openings and surfaces such as are needed for supporting the various movable parts of the thermal and the magnetic tripping device.

The support part 31 is connected in a suitable manner to the lower part 5 of the housing 2, for instance, by screws. An identical support part is likewise fastened in the lower part 5 in a parallel position, whereby lined up bearings arranged at a distance from each other for the parts to be supported are provided. A support opening for the locking strap 17 is designated with 32. A support surface 33 arranged on top thereof is provided for the tripping shaft 14.

Figure 3:
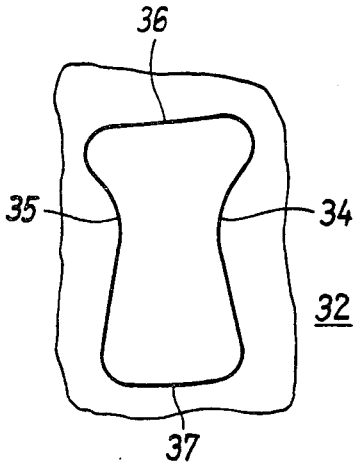
FIGS. 3 and 4 show an enlarged view of support openings of two different designs.

From the enlarged view of the support opening 32 in FIG. 3 it can be seen that within its generally elongated shape, two longer surfaces provided with convex curvatures, 34 and 35, are opposite each other and that the one of the smaller surfaces 36 likewise has a convex curvature. The convex curvature of the longer surfaces 34 and 35 is not distributed uniformly over the entire length, but non-uniformly in such a manner that the narrowest point of the support opening is located at about $\frac{2}{3}$ of the height of the support opening 32. The transition between all the surfaces mentioned is rounded.

Figure 4:
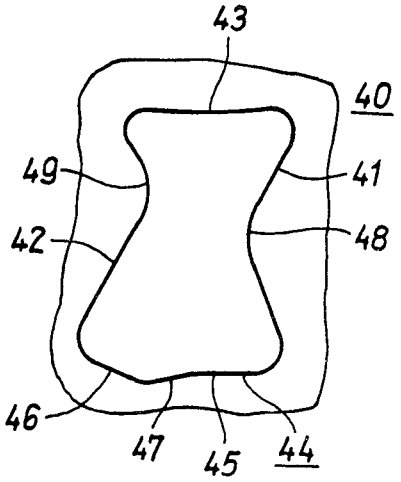

In the further embodiment example of a support opening 40 according to FIG. 4, longer surfaces of convex shape, 41 and 42, as well as a smaller surface 43, likewise with convex curvature, are again provided. The surface 44 opposite the latter is divided into two approximately straight subsurfaces 45 and 46, which are connected by a transition surface 47. The subsurfaces 45 and 46 are at an acute angle to each other. Different from the example of FIG. 3 is also the location of the areas 48 and 49 of the long surfaces 41 and 42 which are most curved. These areas are not opposite each other but are offset approximately in such a way that the area 48 with the greatest curvature of the surface 41 is located at about one-half the height of the support opening 40, while the area 49 with the greatest curvature of the surface 42 is arranged at about $\frac{2}{3}$ to $\frac{3}{4}$ of the height of the support opening 40. This asymmetry is matched to the angular positions of the pivot of the locking member engaging the support opening, which are provided as will be explained later on.

Figure 5:
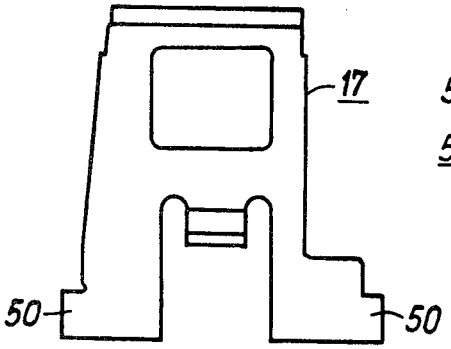
FIG. 5 shows a locking strap separately.

The pivots of the locking strap 17 have a rectangular cross-section, as can be seen in FIG. 5. The two pivots 50 lie on one axis, which represents the axis of rotation or tilting of the locking strap.

Figure 6:
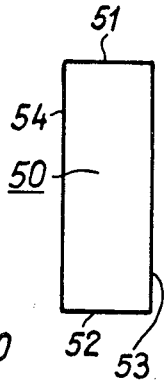
FIG. 6 is the front view of a pivot.
Figure 7:
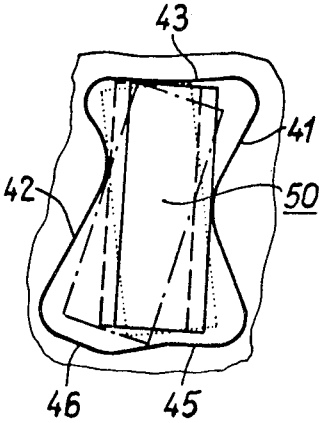
FIG. 7 is an enlarged view of a support opening with a pivot engaging therewith in different switch positions.

In FIG. 7, a support opening corresponding to the support opening 40 (FIG. 4) and a pivot 50 engaging in the support opening is shown enlarged. The individual surfaces of the pivot 50 are designated in FIG. 6. The position drawn in solid lines is occupied by the pivot 50 in the "on" position of the circuit breaker 1. Under the influence of the force exerted by the latch 21 (FIG. 1) on the extension 20 of the locking latch 17, the pivot rests with its upper small surface 51 against the convex surface 43 and with its right long surface 53 against the right-hand convex surface 41. During the transition into the "off" position, shown dashed, a slight sliding motion occurs between the pivot and the surface 43. The left-hand long surface 54 rests against the convex surface 42.

Upon being tripped, the position of the pivot 50 shown in dotted lines occurs. There, sliding on the surface 43 and rolling at the surface 41 take place initially. Subsequently, the pivot 50 rests against the opposite surface 42 while further sliding takes place on the surface 43.

The position of the pivot drawn in dash-dotted lines is obtained when the operating handle is reset in preparation of reclosing (reset position). The lower small surface 52 moves from the subsurface 45 to the subsurface 46, which process is accompanied by sliding. The forces acting in the direction of these surfaces do not change the properties in the "on" position. In the reset position, the left-hand long surface 54 of the pivot 50 rests against the left-hand convex surface 42.

As can be seen from FIG. 7, contact between the walls of the support opening and the pivot takes place only in certain regions. It is therefore not necessary to make the entire surface of the support opening with the same high quality which is desired for the contact surfaces. It is rather sufficient if the upper convex surface 43 as well as the lateral regions 48 and 49 of the convex surfaces 41 and 42 with the greatest curvature as well as the lower surface 44 have a small surface roughness suitable for rolling and sliding processes. The regions above and below the regions of the convex surfaces 47 and 48 with the greatest curvature, as well as all corners can have more surface roughness, however. In addition, the support can also be provided with a suitable permanent lubricant after assembly. When viewing the figures, it should be noted that for FIG. 1 a presentation with sides reversed from FIGS. 2 to 7 was chosen.

What is claimed is:

1. In a locking arrangement for electric circuit breakers including:

(a) a locking strap rotatably or tiltable supported, by means of two pivots lying on a common ideal axis, in support openings in stationary parts, the cross section of the pivots being rectangular; and (b) a latch held, in the closed position of the circuit breaker, against a biasing force by said locking strap, said biasing force applied to said locking strap by said latch in such a manner that one of the small surfaces of the pivots is acted upon by said biasing force the improvement comprising:

(c) the support openings having a convex surface along a short surface thereof and a further convex surfaces along two opposed long surface thereof and the one small surface of each pivot being disposed opposite said convex surface of the corresponding support opening and the long surfaces of each pivot each being disposed, with play, opposite said further convex surface of the support opening.

2. The improvement according to claim 1, wherein the other small surface of each support opening is a concave surface, the other small surfaces of said pivots disposed opposite said other small surface of said openings.

3. The improvement according to claim 1, wherein the other small surface of each support opening is a counter surface of the support opening formed by two subsurfaces which are at an acute angle to each other and are connected by a transition arc, the other small surfaces of said pivots disposed opposite said other small surface of said openings.

4. The improvement according to claim 1, wherein the regions of the convex surfaces of both long surfaces of the support opening are displaced with respect to each other.

* * * * *